US008550129B2

(12) United States Patent
Bonner

(10) Patent No.: US 8,550,129 B2
(45) Date of Patent: Oct. 8, 2013

(54) VAPOR-RECOVERY-ACTIVATED AUTO-SHUTOFF NOZZLE, MECHANISM AND SYSTEM

(75) Inventor: Mark Bonner, Frenchtown, NJ (US)

(73) Assignee: Fuel Transfer Technologies Inc., Moncton, New Brunswick (CA)

( * ) Notice: Subject to any disclaimer, the term of this patent is extended or adjusted under 35 U.S.C. 154(b) by 1193 days.

(21) Appl. No.: 11/943,568

(22) Filed: Nov. 20, 2007

(65) Prior Publication Data

US 2008/0295916 A1 Dec. 4, 2008

Related U.S. Application Data

(60) Provisional application No. 60/860,111, filed on Nov. 20, 2006.

(51) Int. Cl.

| | |
|---|---|
| ***B65B 31/00*** | (2006.01) |
| ***B65B 1/30*** | (2006.01) |
| ***B65B 3/28*** | (2006.01) |
| ***B65B 57/06*** | (2006.01) |
| ***B65B 57/14*** | (2006.01) |

(52) U.S. Cl.
USPC ..... 141/206; 141/59; 141/63; 141/198; 141/209; 141/217; 141/225

(58) Field of Classification Search
USPC ..... 141/59, 60, 63, 64, 198, 206, 209, 141/217, 225, 226
See application file for complete search history.

(56) References Cited

U.S. PATENT DOCUMENTS 4,141,393 A * 2/1979 Mayer ..... 141/206
4,497,350 A * 2/1985 Guertin ..... 141/206
5,327,949 A 7/1994 Dotson et al.
5,379,811 A * 1/1995 Dotson et al. ..... 141/206
5,392,824 A * 2/1995 Rabinovich ..... 141/59

(Continued)

FOREIGN PATENT DOCUMENTS

EP 2106384 B1 4/2013
WO 2008061352 A2 5/2008

OTHER PUBLICATIONS

Davies Collison Cave, "Response to Examination Report" for corresponding Australian Patent Application No. 2007324311, dated Jul. 18, 2012, Australia.
Gupta, Santosh—Australian Patent Office, "Examination Report No. 2" for corresponding Australian Patent Application No. 2007324311, dated Jul. 20, 2012, Australia.

(Continued)

*Primary Examiner* — Ryan Reis
(74) *Attorney, Agent, or Firm* — Norton Rose Fulbright Canada LLP

(57) ABSTRACT

A vapor-recovery-activated auto-shutoff nozzle comprises a manually operable trigger that permits selective operation of a normally closed valve between a valve-closed configuration and a valve-open configuration. Linkage arms connect the trigger and the valve, and are re-configurable between an enabled configuration and a disabled configuration. In the enabled configuration, the trigger and the valve are operatively connected such that the rest position of the trigger corresponds to the valve being closed, and the in-use position of the manually operable trigger corresponds to the valve being open. In the disabled configuration, the manually operable trigger is precluded from controlling the valve. A deactivation mechanism is for re-configuring the linkage means from the enabled configuration to the disabled configuration, in response to a condition of the fluid in a vapor recovery conduit of the nozzle, thereby precluding the valve from being controlled until the linkage arms are reset to the enabled configuration.

20 Claims, 11 Drawing Sheets

(56) References Cited

U.S. PATENT DOCUMENTS

| | | | | |
|---|---|---|---|---|
| 5,394,909 | A * | 3/1995 | Mitchell et al. | 141/59 |
| 5,474,115 | A | 12/1995 | Fink, Jr. | |
| 5,813,443 | A * | 9/1998 | Dalhart et al. | 141/206 |
| 6,095,204 | A * | 8/2000 | Healy | 141/59 |
| 7,082,972 | B1 | 8/2006 | Healy | |
| 2003/0057235 | A1 | 3/2003 | Gueret | |
| 2005/0274127 | A1 | 12/2005 | Drube et al. | |

OTHER PUBLICATIONS

Notice of Acceptance from Australian Government dated Apr. 16, 2013 for Australian application No. 2007324311.

International Search Report dated May 2, 2008 for International application No. PCT/CA2007/002081.

International Preliminary Report on Patentability and Written Opinion dated May 26, 2009.

* cited by examiner

VAPOR-RECOVERY-ACTIVATED AUTO-SHUTOFF NOZZLE, MECHANISM AND SYSTEM

This application is a non-provisional application claiming priority from U.S. provisional patent application Ser. No. 60/860,111 filed on Nov. 20, 2007, which is herein incorporated by reference.

FIELD OF THE INVENTION

The present invention relates to a vapor-recovery-activated auto-shutoff nozzle for delivering liquid from a liquid source, and more particularly relates to a vapor-recovery-activated auto-shutoff nozzle for delivering liquid from a liquid source, wherein the liquid is volatile.

BACKGROUND OF THE INVENTION

Automatic shutoff nozzles, such as those used in gasoline filling stations, conventionally have a main liquid flow conduit for delivering liquid through the nozzle so that it may be expelled from the spout of the nozzle and into a receiving container, such as a gas tank in a vehicle. Such automatic shutoff nozzles typically use the reduced pressure created by an inline Venturi, to automatically shut off the flow of fluid passing through the main liquid flow conduit when the receiving container becomes full. This detection of liquid occurs when the receiving container becomes nearly full.

The flow of liquid through such automatic shutoff nozzles passes through a Venturi, which creates a reduced pressure and in turn generates a flow of air and vapor within the nozzle. The flow of air and vapor created by the Venturi is plumbed so as to be drawn from the tip of the nozzles spout and is introduced into the flow of liquid, which is exiting the nozzle.

The flow of liquid through these Venturi style nozzles is caused to automatically terminate when the fluid levels in the receiving container rise to cover the vapor inlet at the tip of the spout of the nozzle. This automatic termination occurs because the viscosity of the liquid is greater than the viscosity air. The liquid covering the tip will not flow readily into the air inlet of the spout, and this lag will cause the pressure within the airway to the Venturi to decrease.

The decrease in pressure will cause the nozzle to "click off" because in addition to the airway of the Venturi being plumbed to the tip of the spout, the airway is also plumbed to a diaphragm connected to a linkage system that interconnects the hand actuated trigger and the nozzle's liquid control valve. The decrease in pressure within the airway of the Venturi will cause the diaphragm to actuate mechanisms that cause the linkage system to disengage the trigger from the valve, thus allowing the valve to close and terminate the flow of liquid through the nozzle.

One such system is disclosed in U.S. Pat. No. 5,474,115 issued Dec. 12, 1995, to Fink, Jr. and entitled Specialty Fuel Dispensing Nozzle. The main valve (a poppet valve) is opened by the operating lever, the rush of fuel through the nozzle body unseats a check valve so fuel can flow through the Venturi to the nozzle spout and outlet. The Venturi is installed in a circular housing which defines the outlet. There is a shutoff assembly that is controlled, in part, by a diaphragm assembly. A chamber is defined above the diaphragm assembly which is connected to the Venturi by an air passage. When fuel flows over the Venturi, a partial vacuum is created that is communicated to the chamber via the air passage.

The fuel dispensing nozzle has a vent tube extending through a spout of the nozzle and automatic shut off device in communication with, and responsive to, the passage of air through the vent tube. The outer end of the vent tube terminates in an air port at the tip of the spout. A tip, forming a valve, is placed at the outer end of the vent tube. The valve has a magnetic responsive valve member and a seat formed at the junction of tip and the vent tube. The vacuum created by the nozzle seats the magnetic valve member against the seat to close the tube.

The vent tube is operatively connected at its opposite other end to an air passage that is in fluid communication with the Venturi. During fuel flow, the Venturi creates a vacuum that draws air through the vent tube from its outer end to its inner end. This flow of air prevents a vacuum from occurring in the chamber, thus preventing the operation of the automatic shut-off. When the outer end of the vent tube is blocked by fuel, a vacuum is created in the vent tube. Accordingly, the vacuum created by the Venturi causes a corresponding vacuum in the chamber via the air passage, thus allowing the operation of the automatic shut-off.

It is the object of this invention to provide an auto-shutoff nozzle, which utilizes the airflow within the vapor recovery means of the nozzle to cause the nozzle to automatically shut off when the receiving container is nearly full.

It is the object of this invention to provide an auto-shutoff nozzle, which utilizes the reduced air pressure of the airflow within the vapor recovery means of the nozzle to cause the nozzle to automatically shut off when the receiving container is nearly full.

It is the object of this invention to provide an auto-shutoff nozzle, which is usable in a portable fuel transfer system, and which is responsive to conditions of the airflow within the vapor recovery means of the nozzle to cause the nozzle to automatically shut off when the receiving container is nearly full.

It is the object of this invention to provide an auto-shutoff nozzle, which nozzle is usable in a gasoline filling station, and which is responsive to conditions of the airflow within the vapor recovery means of the nozzle to cause the nozzle to automatically shut off when the receiving container is nearly full.

It is the object of this invention to provide an auto-shutoff nozzle with a removable spout, which is responsive to conditions of the airflow within the vapor recovery means of the nozzle to cause the nozzle to automatically shut off when the receiving container is nearly full.

It is the object of this invention to provide an auto-shutoff nozzle, which is responsive to conditions of the airflow within the vapor recovery means of the nozzle to cause the nozzle to automatically shut off when the receiving container is nearly full, and wherein the spout is an auto-closure spout.

It is the object of this invention to provide an auto-shutoff nozzle, which is responsive to conditions of the airflow within the vapor recovery means of the nozzle to cause the nozzle to automatically shut off when the receiving container is nearly full, and wherein the nozzle is usable in a liquid delivery system having vapor recovery.

SUMMARY OF THE INVENTION

In accordance with one aspect of the present invention there is disclosed a novel vapor-recovery-activated auto-shut-off nozzle for delivering liquid from a liquid source. The vapor-recovery-activated auto-shutoff nozzle comprises a liquid delivery conduit having a liquid-receiving inlet and a liquid-dispensing outlet. A vapor recovery conduit has a vapor-receiving inlet and a vapor-conveying outlet. An openable and closable valve means is selectively movable between a valve-closed configuration whereat liquid is precluded from being dispensed from the liquid-dispensing outlet of the liquid delivery conduit and a valve-open configuration whereat liquid is permitted to be dispensed from the liquid-dispensing outlet of the liquid delivery conduit. There is a biasing means for biasing the valve means to the valve-closed configuration. A manually operable trigger means is movable between a rest position and at least one in-use position, for permitting selective operation of the valve means between the valve-closed configuration and the valve-open configuration. A linkage means operatively connects the manually operable trigger means and the valve means. The linkage means is re-configurable between an enabled configuration whereat the valve means is controllable via the manually operable trigger means, such that the rest position of the manually operable trigger means corresponds to the valve-closed configuration of the valve means and the in-use position of the manually operable trigger means corresponds to the valve-open configuration of the valve means, and a disabled configuration whereat the manually operable trigger means is precluded from controlling the valve means, and the valve means is therefore biased to the valve-closed configuration. There is a deactivation means for re-configuring the linkage means from the enabled configuration to the disabled configuration, in response to a condition of the fluid in the vapor recovery conduit, thereby precluding the openable and closable valve means from being controlled by the manually operable trigger means to its open configuration, until the linkage means is reset to its enabled configuration.

In accordance with another aspect of the present invention there is disclosed a novel vapor-recovery-activated auto-shutoff mechanism for use in a nozzle. The nozzle is for delivering liquid from a liquid source and including a liquid delivery conduit and a vapor recovery conduit. The vapor-recovery-activated auto-shutoff mechanism comprises a linkage means for operatively connecting a manually operable trigger means and a normally closed valve means, and is re-configurable between an enabled configuration whereat the valve means is controllable via the manually operable trigger means, and a disabled configuration whereat the manually operable trigger means is precluded from controlling the valve means, and the valve means is in its normally closed configuration. There is a deactivation means for re-configuring the linkage means from the enabled configuration to the disabled configuration, in response to a condition of the fluid in the vapor recovery conduit, thereby precluding the normally closed valve means from being controlled by the manually operable trigger means to its open configuration, until the linkage means is reset to its enabled configuration.

In accordance with yet another aspect of the present invention there is disclosed a novel vapor-recovery-activated auto-shutoff fluid exchange system for concurrently pumping liquid from a source container to a destination container and pumping vapor from the destination container to the source container. The vapor-recovery-activated auto-shutoff fluid exchange system comprises a source container having a substantially hollow interior for retaining liquid and vapor therein. A liquid and vapor pumping means is for pumping liquid from the source container to the destination container and for pumping vapor from the destination container to the source container, and having a liquid inlet, a liquid outlet, a vapor inlet and a vapor outlet. The liquid inlet and the vapor outlet of the liquid and vapor pumping means are connected in fluid communication with the substantially hollow interior of the source container. A nozzle has a liquid delivery conduit having a liquid-receiving inlet and a liquid-dispensing outlet and vapor recovery conduit having a vapor-receiving inlet and a vapor-conveying outlet. There is a liquid delivery means for delivering liquid from the liquid outlet of the liquid and vapor pumping means to the liquid-receiving inlet of the nozzle, and a vapor delivery means for delivering vapor from the vapor-conveying outlet of the nozzle to the vapor inlet of the liquid and vapor pumping means. A selectively controllable actuation mechanism is provided for actuating the liquid and vapor pumping means. An openable and closable valve means is selectively movable between a valve-closed configuration whereat liquid is precluded from being dispensed from the liquid-dispensing outlet of the liquid delivery conduit and a valve-open configuration whereat liquid is permitted to be dispensed from the liquid-dispensing outlet of the liquid delivery conduit. There is a biasing means for biasing the valve means to the valve-closed configuration. A manually operable trigger means is movable between a rest position and at least one in-use position, for permitting selective operation of the valve means between the valve-closed configuration and the valve-open configuration. A linkage means operatively connects the manually operable trigger means and the valve means. The linkage means is re-configurable between an enabled configuration whereat the valve means is controllable via the manually operable trigger means, such that the rest position of the manually operable trigger means corresponds to the valve-closed configuration of the valve means and the in-use position of the manually operable trigger means corresponds to the valve-open configuration of the valve means, and a disabled configuration whereat the manually operable trigger means is precluded from controlling the valve means, and the valve means is therefore biased to the valve-closed configuration. There is a deactivation means for re-configuring the linkage means from the enabled configuration to the disabled configuration, in response to a condition of the fluid in the vapor recovery conduit, thereby precluding the openable and closable valve means from being controlled by the manually operable trigger means to its open configuration, until the linkage means is reset to its enabled configuration.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described herein below.

BRIEF DESCRIPTION OF THE DRAWINGS

The novel features which are believed to be characteristic of the vapor-recovery-activated auto-shutoff mechanism, nozzle and system according to the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF THE PREFERRED EMBODIMENTS

Figure 5:
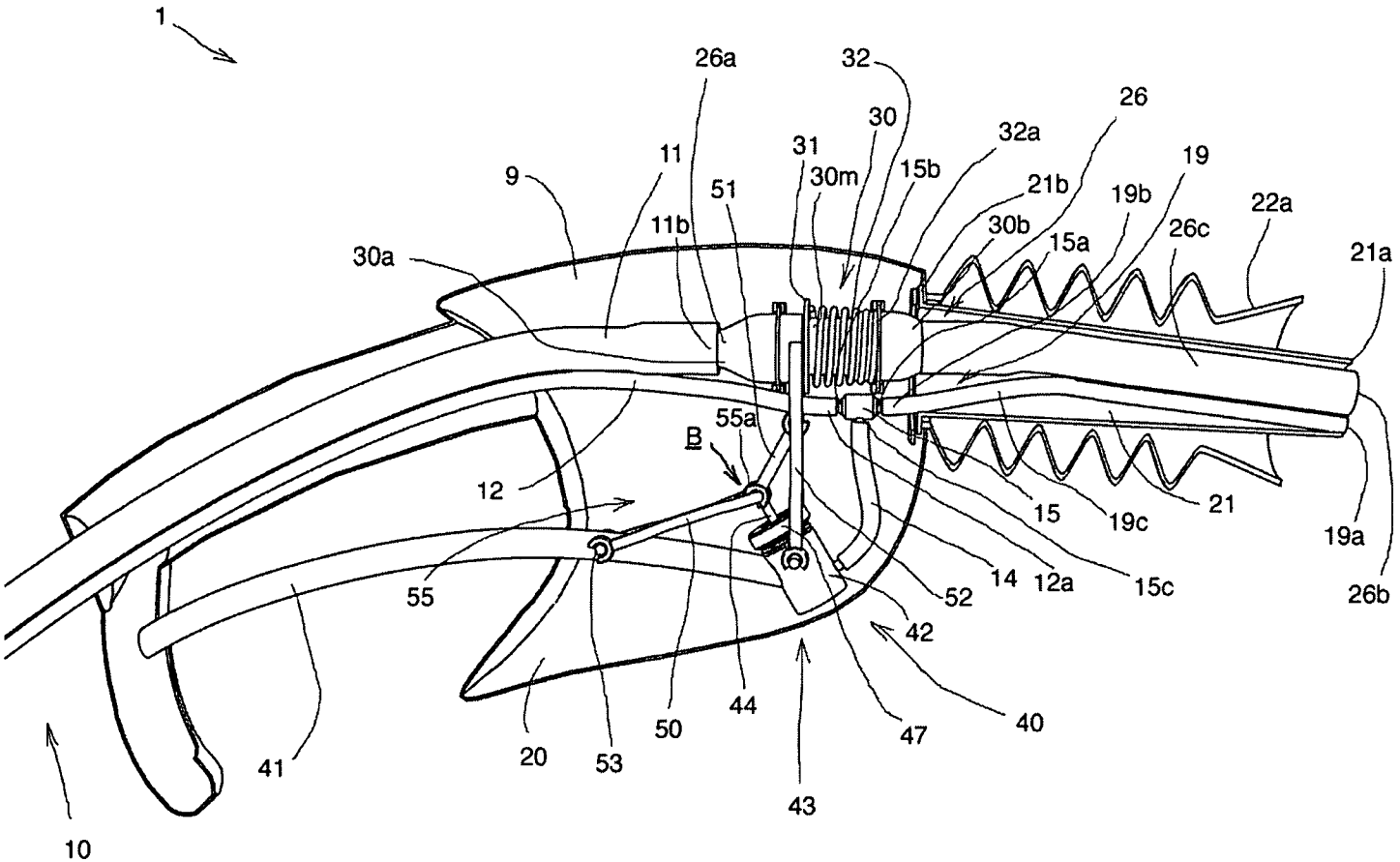
FIG. 5 is a sectional side elevational view similar to FIG. 4, but with the deactivation means having re-configured the linkage means from its enabled configuration to its disabled configuration, and the valve having moved back to its valve-closed configuration.
Figure 6:
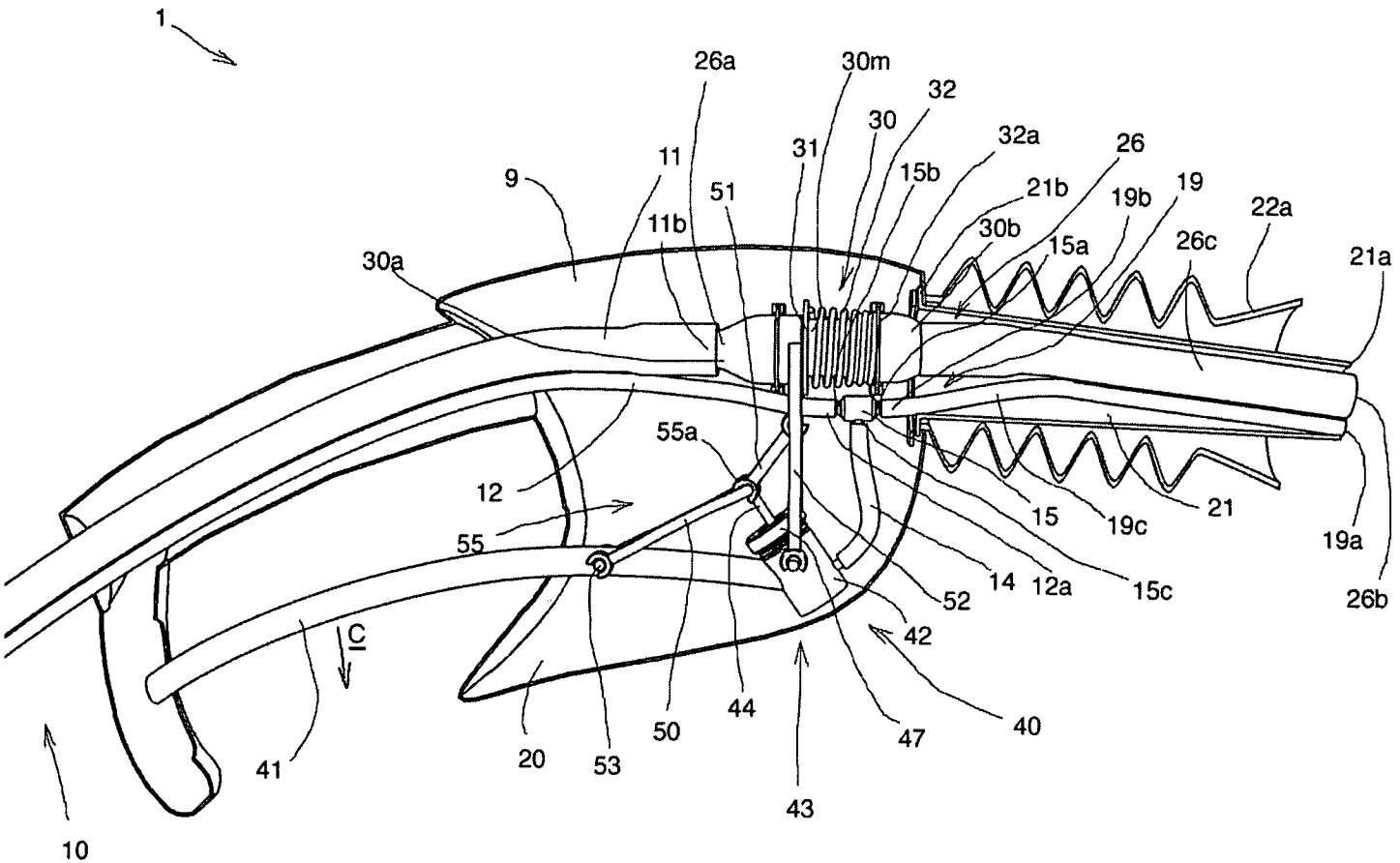
FIG. 6 is a sectional side elevational view similar to FIG. 5, but with the manually operable trigger moving back to its rest position.
Figure 7:
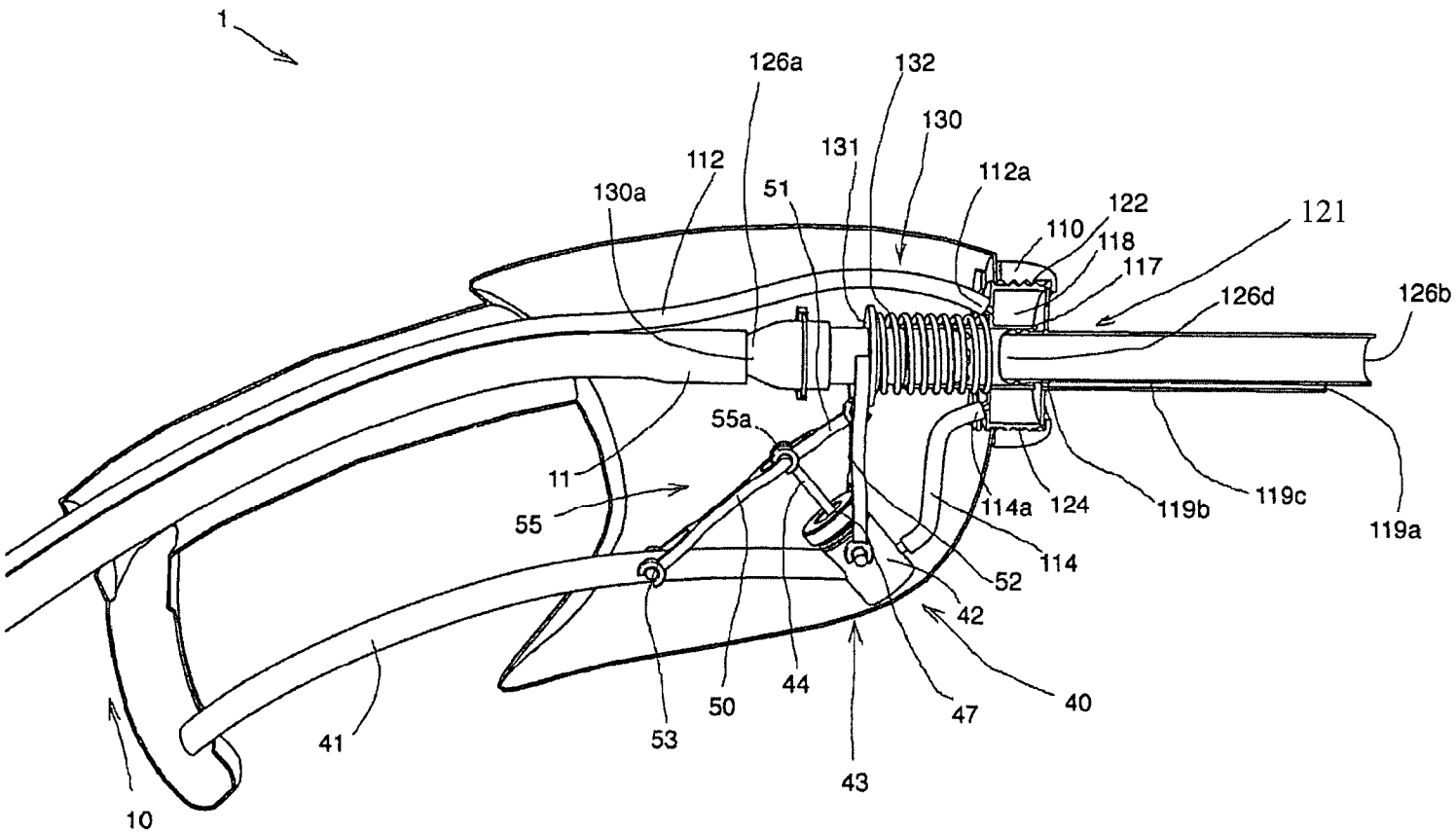
FIG. 7 is a sectional side elevational view similar to FIG. 6, but is an alternative embodiment of the first preferred embodiment of the present invention.
Figure 8:
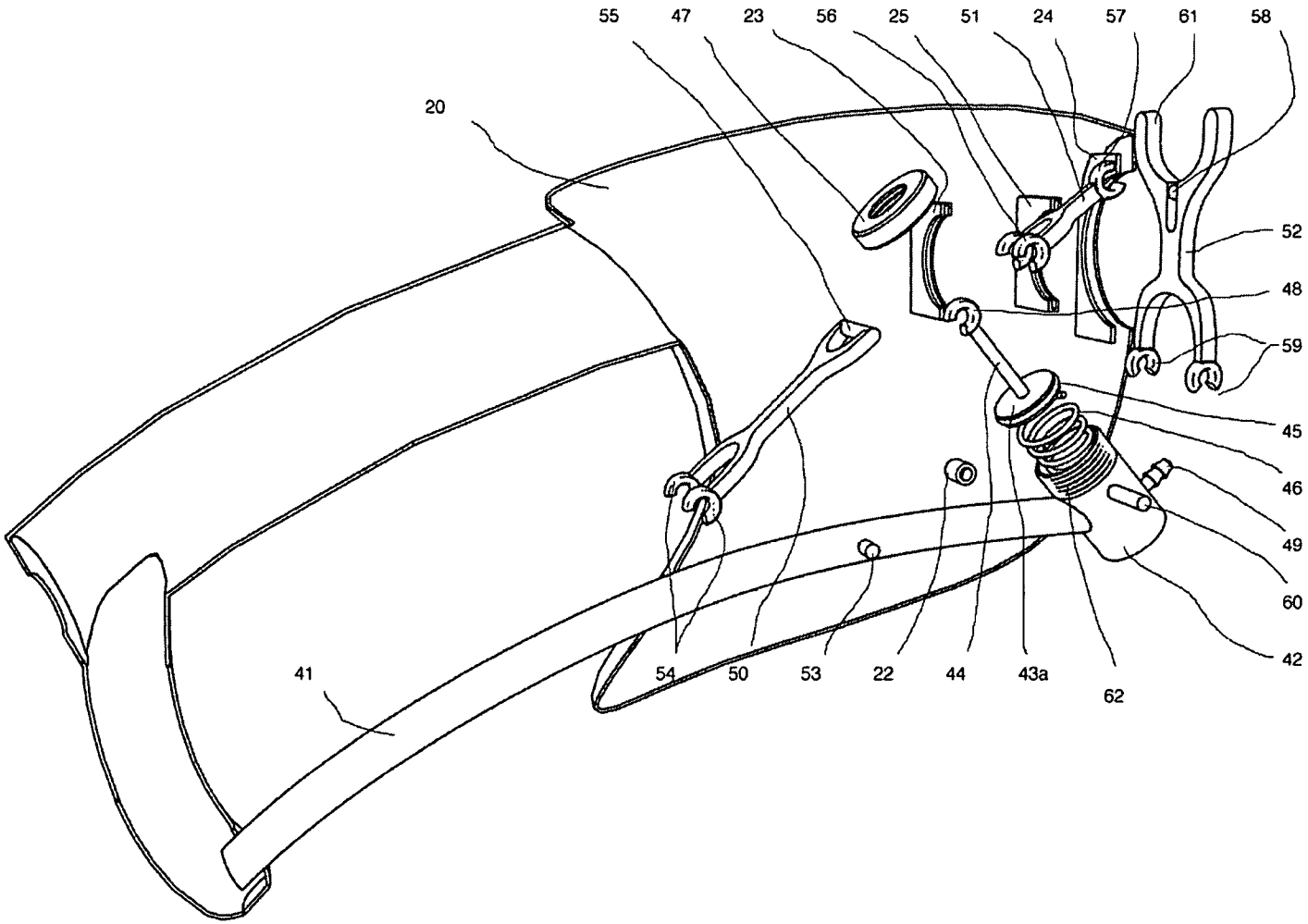
FIG. 8 is an exploded perspective view of the first preferred embodiment nozzle of FIG. 1.
Figure 9:
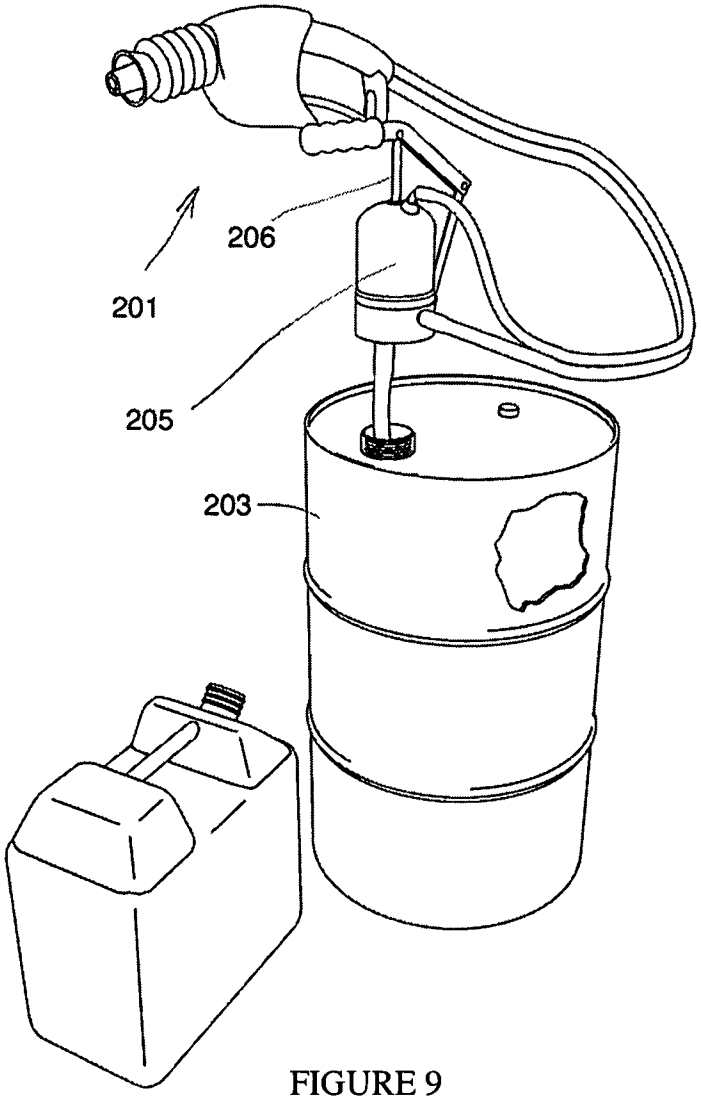
FIG. 9 is a perspective view of the second preferred embodiment of the nozzle and system according to the present invention.
Figure 10:
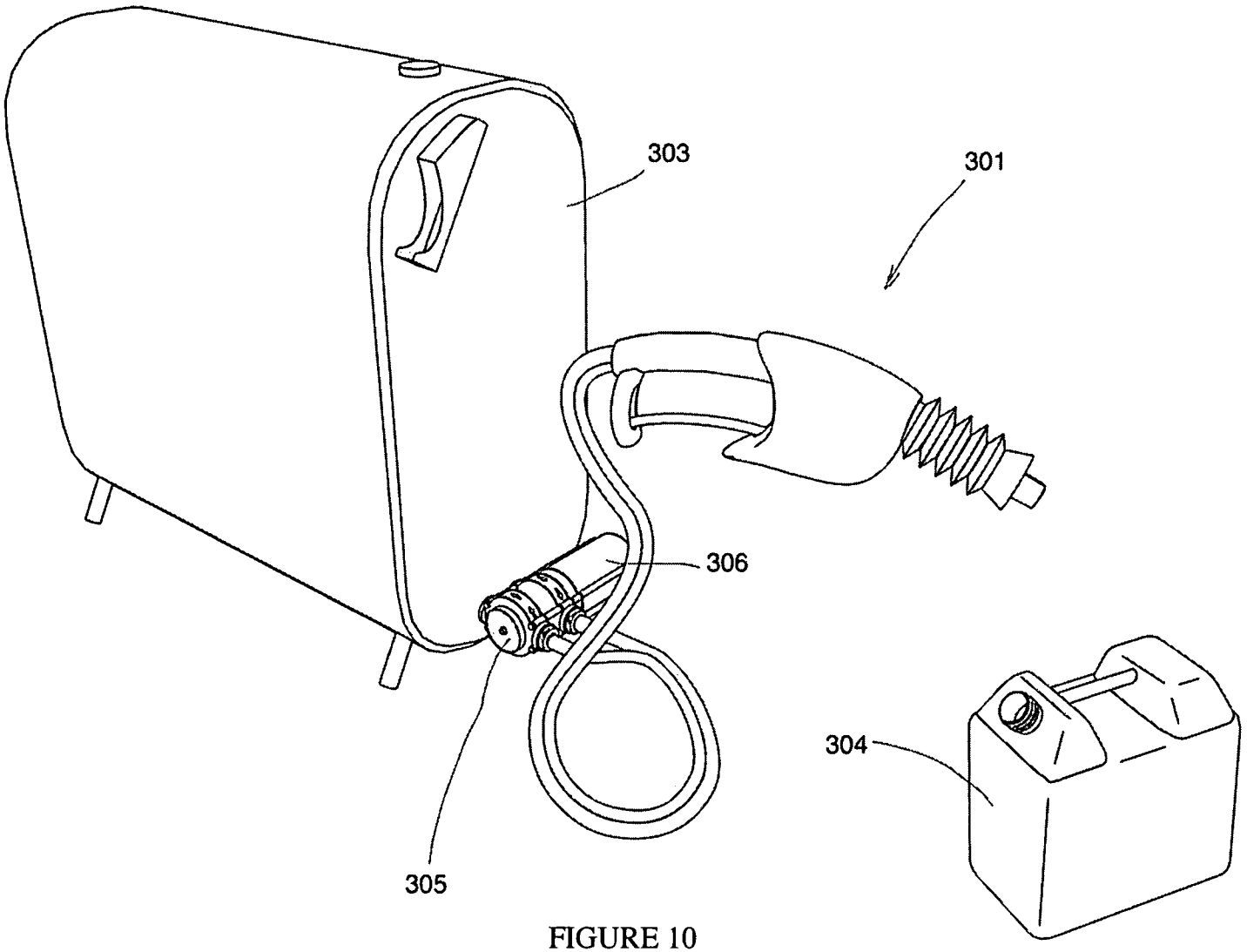
FIG. 10 is a perspective view of the third preferred embodiment of the nozzle and system according to the present invention; and, FIG. 11 is a perspective view of the fourth preferred embodiment of the nozzle and system according to the present invention.
Figure 11:
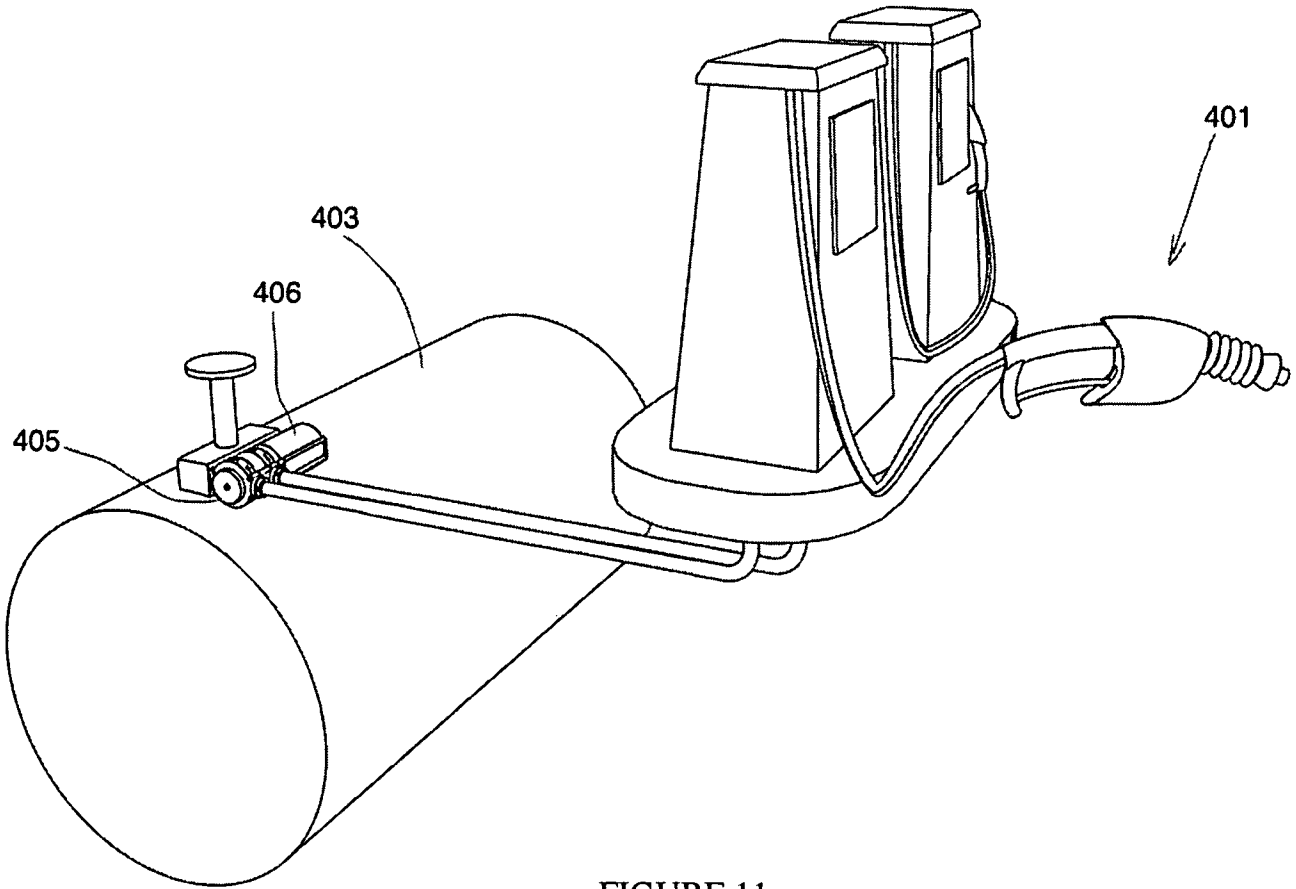

Referring to FIGS. 1 through 11 of the drawings, it will be noted that FIGS. 1 through 8 illustrate a first preferred embodiment of the auto-shutoff mechanism, nozzle and system of the present invention, with FIG. 7 illustrating an alternative embodiment, FIG. 9 illustrates a second preferred embodiment of the auto-shutoff mechanism, nozzle 1 and system of the present invention, FIG. 10 illustrates a third preferred embodiment of the auto-shutoff mechanism, nozzle 1 and system of the present invention, and FIG. 11 illustrates a fourth preferred embodiment of the auto-shutoff mechanism, nozzle 1 and system of the present invention.

Reference will now be made to FIGS. 1 through 8, which show a first preferred embodiment of the auto-shutoff mechanism, nozzle 1 and system of the present invention. The vapor-recovery-activated auto-shutoff nozzle 1, as indicated by the general reference numeral 1, is for delivering liquid from a liquid source to a destination. In another aspect, the present invention also comprises a vapor-recovery-activated auto-shutoff mechanism 40 for use in a nozzle 1.

Figure 1:
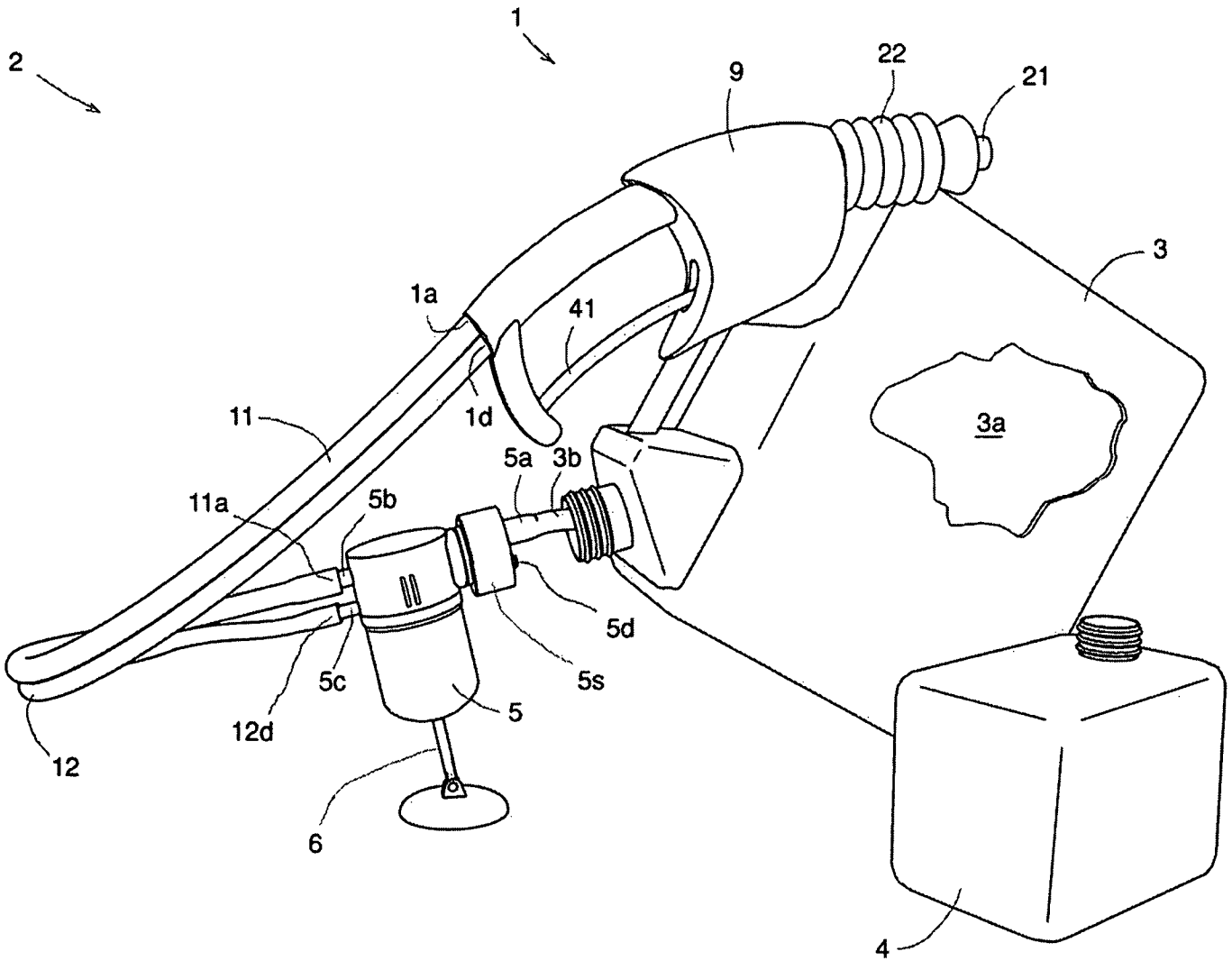
FIG. 1 is a perspective view of the first preferred embodiment of the nozzle and system according to the present invention.
Figure 2:
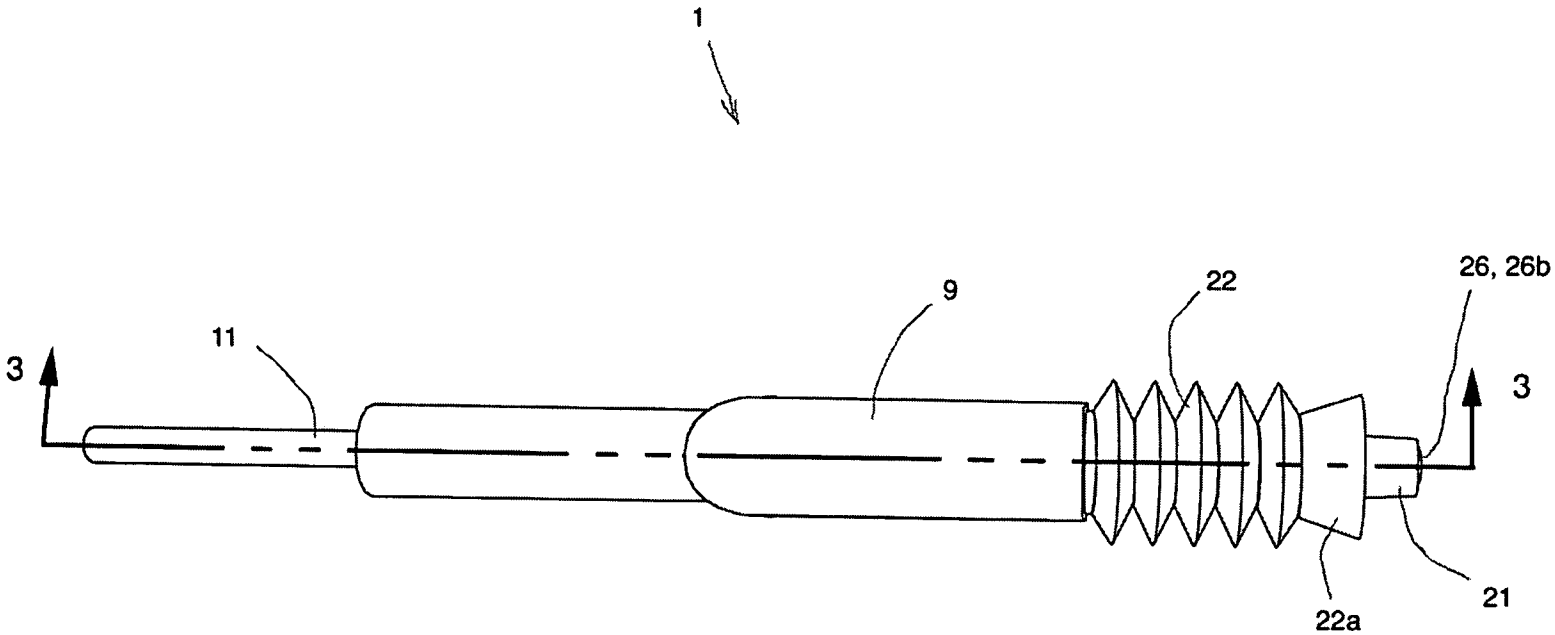
FIG. 2 is a top view of the first preferred embodiment nozzle of FIG. 1.

Further, the present invention also comprises a vapor-recovery-activated auto-shutoff fluid exchange system 2, as is best seen in FIG. 1, for concurrently pumping liquid from a source container 3 to a destination container 4 and pumping vapor from the destination container 4 to the source container 3. The vapor-recovery-activated auto-shutoff fluid exchange system 2 comprises a source container 3, a liquid and vapor pumping means 5, a nozzle 1, a liquid delivery means 11, a vapor delivery means 12, a selectively controllable actuation mechanism 6, an openable and closable valve means 30, a biasing means 32 for biasing the valve means 30 to its valve-closed configuration, a manually operable trigger means 41, a linkage means 55, and a deactivation means 40.

Reference will now be made to FIGS. 1 through 8 to describe the present invention in detail. The vapor-recovery-activated auto-shutoff fluid exchange system 2 comprises a source container 3 having a substantially hollow interior 3*a* capable of retaining liquid and vapor therein, in sealed relation with respect to the ambient environment. As illustrated, the source container 3 comprises a larger portable fuel container and the destination container 4 comprises a smaller portable fuel container. Alternatively, the destination container could comprise any other suitable type of approved container, including the fuel tank of a vehicle or other apparatus having an internal combustion engine.

The vapor-recovery-activated auto-shutoff fluid exchange system 2 also comprises the liquid and vapor pumping means 5 for pumping liquid from the source container 3 to the destination container 4 and for pumping vapor from the destination container 4 to the source container 3. The liquid and vapor pumping means 5 has a liquid inlet 5*a*, a liquid outlet 5*b*, a vapor inlet 5*c* and a vapor outlet 5*d*. As illustrated in FIG. 1, the liquid and vapor pumping means 5 comprises foot operable pump, shown separate from the source container 3 for the sake of clarity, which is installed in sealed relation on the mouth of the source container 3 via a screw cap 5*s*. The liquid inlet 5*a* and the vapor outlet 5*d* of the liquid and vapor pumping means 5 are connected in fluid communication with the substantially hollow interior 3*a* of the source container 3. An extension hose 3*b* connects to the liquid inlet 5*a* and extends down to the bottom of the source container 3 in order to draw liquid from the source container 3. An actuation means 6, which comprises a piston rod member that is operatively connected to the piston (not specifically shown) within the liquid and vapor pump 5.

Figure 3:
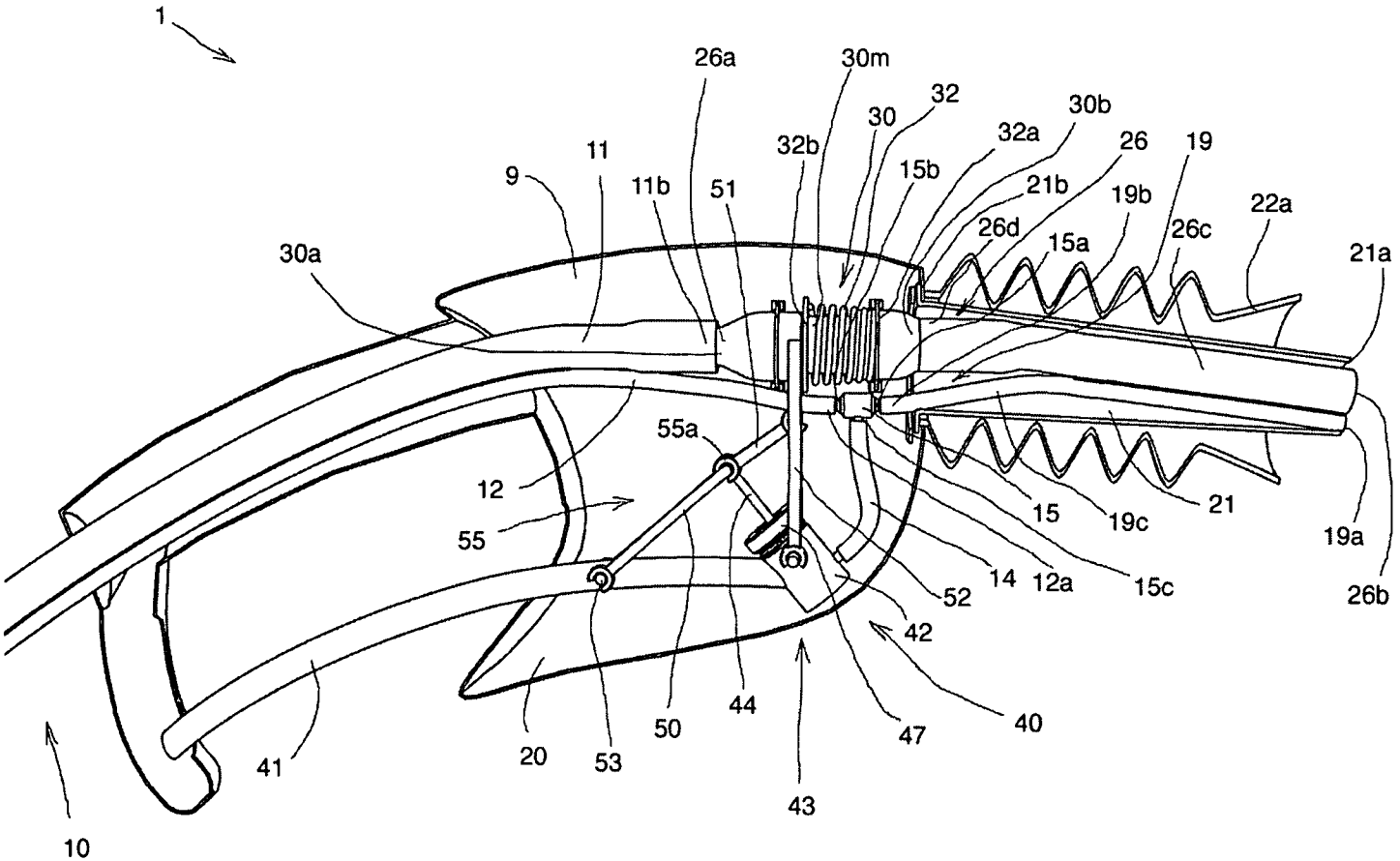
FIG. 3 is a sectional side elevational view of the first preferred embodiment nozzle of FIG. 1, taken along section line 3-3 of FIG. 2, with the valve in a valve-closed configuration, the manually operable trigger in a rest position, and the linkage means in an enabled configuration.

There is a liquid delivery means 11 for delivering liquid from the liquid outlet 5*b* of the liquid and vapor pumping means 5 to the liquid-receiving inlet 1*a* of the nozzle 1. In the first preferred embodiment, the liquid delivery means 11 comprises an elongate flexible liquid delivery hose 11 securely connected to a barbed hose fitting (not specifically shown) at the liquid outlet 5*b* of the liquid and vapor pumping means 5. Accordingly, the elongate flexible liquid delivery hose 11 is in fluid communication at the liquid inlet 11*a* with the liquid outlet 5*b* of the liquid and vapor pumping means 5 for receiving liquid from the liquid and vapor pumping means 5. Further, in use, as can be seen in FIG. 3, the elongate flexible liquid delivery hose 11 is in fluid communication at the liquid outlet 11*b* with the liquid delivery conduit 26, which conveys the liquid from the liquid outlet 11*b* of the elongate flexible liquid delivery hose 11 to the destination container 4. In the first preferred embodiment, the liquid delivery conduit 26 comprises the valve 30 and the liquid conduit 26*c*.

There is also a vapor delivery means 12 for delivering vapor from the vapor-conveying outlet 1*d* of the nozzle 1 to the vapor inlet 5*c* of the liquid and vapor pumping means 5. In the first preferred embodiment, the vapor delivery means 12 comprises an elongate flexible vapor delivery hose 12 securely connected to a barbed hose fitting (not specifically shown) at the vapor inlet 5*c* of the liquid and vapor pumping means 5. Accordingly, the elongate flexible vapor delivery hose 12 is in fluid communication at the vapor outlet 12*d* with the vapor inlet 5*c* of the liquid and vapor pumping means 5 for delivering vapor to the liquid and vapor pumping means 5. Further, in use, as can be seen in FIG. 1, the elongate flexible vapor delivery hose 12 is in fluid communication at the vapor inlet 12*a* with the destination container 4 through the vapor recovery conduit 19, which conveys the vapor from the destination container 4 to the vapor inlet of the elongate flexible vapor delivery hose 12. In the first preferred embodiment, the vapor recovery conduit 19 comprises a flexible tube 19*c* and a "T"-connection 15.

In the first preferred embodiment, as illustrated, the elongate flexible liquid delivery hose 11 and the elongate flexible vapor delivery hose 12 are formed together as a two line hose 10.

In FIGS. 1 through 6, the nozzle comprises a nozzle body 9 and the spout 21. The spout 21 has a proximal end 21*b* and a distal end 21*a*, and is attached at its proximal end 21*b* to the nozzle body 9 so as to extend outwardly from the nozzle body 9. The spout 21 is shaped and dimensioned for insertion into the neck of a fuel intake pipe of a vehicle or into the mouth of a portable fuel container.

A flexible bellows member 22 having a splash guard portion 22*a* at its forward end is attached to the nozzle 1 at the proximal end 21*a* of the spout and generally surrounds the spout 21.

The first preferred embodiment vapor-recovery-activated auto-shutoff nozzle 1 also comprises a liquid delivery conduit 26 having a liquid-receiving inlet 26*a* and a liquid-dispensing outlet 26*b*. The liquid delivery conduit 26 is disposed within the nozzle 1.

There is also a vapor recovery conduit 19 having a vapor-receiving inlet 19*a* and a vapor-conveying outlet 15*b*. The vapor recovery conduit 19 comprises a flexible tube 19*c* and the "T"-connector 15. The vapor-receiving inlet 19*a* of the vapor recovery conduit 19 is disposed adjacent the distal end of the spout 21 such that, in use, the vapor-receiving inlet 19*a* is within the destination container 4, to thereby readily receive vapor from the destination container 4. The flexible tube 19*c* is attached in sealed relation at its vapor-dispensing outlet 19*b* to a first opening 15*a* of the "T"-connector 15. The inlet end 12*a* of the elongate flexible vapor delivery hose 12 is also operatively connected in sealed relation at its vapor inlet 12*a* to a second opening 15*b* of the "T"-connector 15, so as to be in fluid communication with the vapor-conveying outlet 19*b* of the flexible tube 19*c*.

The openable and closable valve means 30 is mounted within the nozzle 1 by a first locating means 23, and a third locating means 25. The valve 30 is connected at its liquid-receiving inlet 30*a* to the liquid outlet 11*b* of the elongate flexible liquid delivery hose 11 so as to receive liquid from the source container 3. The liquid conduit 26*c* is connected at its liquid-receiving inlet 26*d* to the liquid outlet 30*b* of the valve 30. The valve 30 is for controlling the flow of liquid through the vapor-recovery-activated auto-shutoff nozzle 1. The valve means 30 as illustrated, is a trombone style axial flow type valve 30 which is shown to be biased closed by the biasing means 32 for biasing the valve means 30 to the valve-closed configuration. In the first preferred embodiment, the biasing means 32 comprises a coil spring 32 that is operatively mounted between a forward annular flange 32*a* integrally formed on the valve body and a rearward annular flange 32*b* integrally formed on a movable valve mechanism 30*m* so as to be in compression between the forward annular flange 32*a* and the rearward annular flange 32*b*. As can readily be determined, the coil spring 32 is in compression when the normally closed axial flow type valve 30 is in its valve-closed configuration, and is in even greater compression when the normally closed axial flow type valve 30 is in its valve-open configuration (see FIG. 4).

The movable valve mechanism 30*m* on the openable and closable valve means 30 is selectively movable between a valve-closed configuration and a valve-open configuration. In the valve-closed configuration, as can be best seen in FIGS. 3, 5 and 6, liquid in the liquid delivery conduit 26 is precluded from being dispensed from the liquid-dispensing outlet 26*b* of the liquid delivery conduit 26, and therefore precluded from being dispensed from the nozzle 1. In the valve-open configuration, as can be best seen in FIG. 4, the liquid in the liquid delivery conduit 26 is allowed to pass through the liquid delivery conduit 26 so as to be dispensed from the liquid-dispensing outlet 26*b* of the liquid delivery conduit 26.

Figure 4:
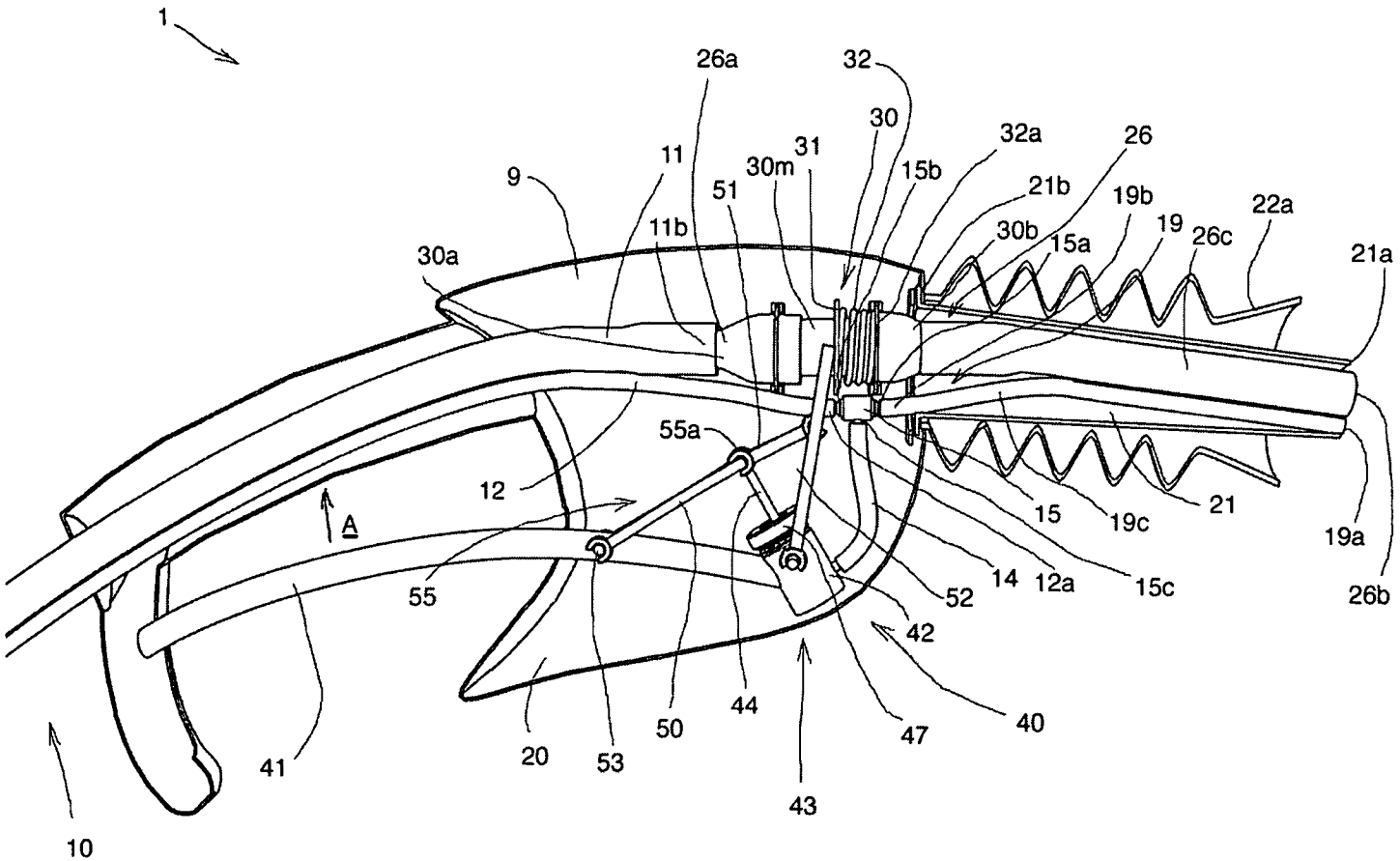
FIG. 4 is a sectional side elevational view similar to FIG. 3, but with the valve in a valve-open configuration and the manually operable trigger in an in-use position.

A manually operable trigger means 41 is movable between a rest position, as is shown in FIGS. 1 and 3, and at least one in-use position, as is shown in FIG. 4. The in-use positions are actually a continuum of in use positions corresponding to the valve being open to a lesser or greater degree. The manually operable trigger means 41 preferably comprises a trigger handle 41 mounted in pivotal relation on the nozzle 1 by means of a pair of pivot posts 60 that engage co-operating bearing recesses 22 (see FIG. 8).

The trigger handle 41 is for permitting selective operation of the valve means 30 between the valve-closed configuration as shown in FIG. 3 and the valve-open configuration as shown in FIG. 4. In this manner, a user can hold the vapor-recovery-activated auto-shutoff nozzle 1 in one hand and can use the same hand to operate the trigger handle 41 to control the valve.

The linkage means 50' operatively connects the manually operable trigger means 41 and the valve means 30. In the first preferred embodiment, as illustrated, the linkage means 50' comprises a first linkage arm 50 and a second linkage arm 51 connected together one to the other at their inner ends in angularly variable relation at a linkage elbow 55*a*. More specifically, the inner end 55 of the first linkage arm 50 is received into the linkage clasp 56 at the inner end of the second linkage arm 51 (see FIG. 8).

Further, the first linkage arm 50 of the linkage means 50' is connected in angularly variable relation to the trigger handle 41. More specifically, the first linkage arm 50 is pivotally connected at its outer end by a linkage clasps 54 to a first linkage pivot post 53 on the trigger handle 41. Further, the second linkage arm 51 of the linkage means 50' is operatively connected to the valve means 30 via the pusher linkage arm 52. More specifically, the linkage clasp 57 of the second linkage arm 51 is pivotally connected at its outer end to a second linkage pivot post 58 (see FIG. 8) on the pusher linkage arm 52. The pusher linkage arm 52 is operatively connected at its top end 61 to the movable valve mechanism 30*m* via abutting contact with the rearward annular flange 32*b*, so as to transfer the movement of the trigger handle 41 to the movable valve mechanism 30*m*, and the linkage arm 52 is pivotally connected at its bottom end by linkage clasp 59 to linkage posts 60 on a cylinder 42.

As can readily be seen in FIGS. 1 through 6 the linkage means 50' is re-configurable between an enabled configuration, as is shown in FIGS. 3 and 4 and a disabled configuration, as is shown in FIGS. 5 and 6, as will be discussed in greater detail subsequently.

In the enabled configuration, the movable valve mechanism 30*m* is controllable via the manually operable trigger means 41, such that the rest position of the manually operable trigger means 41 corresponds to the valve-closed configuration of the valve means 30, as can be seen in FIG. 3. The in-use position of the manually operable trigger means 41 corresponds to the valve-open configuration of the valve means 30, as can be seen in FIG. 4.

In the disabled configuration, the first linkage arm 50 and the second linkage arm 52 can move angularly with respect to each other. Accordingly, if the trigger handle 41 is operated, or in other words moved upwardly by a user, the motion of the trigger handle 41 moves first linkage arm 50 and the second linkage arm 51 angularly with respect to each other. This motion is not passed on to the pusher linkage arm 52 and the rearward annular flange 32 of the movable valve mechanism 30*m*. Therefore, the manually operable trigger means 41 is precluded from controlling the valve means 30. The valve means 30 therefore remains biased to the valve-closed configuration, as can be seen in FIGS. 5 and 6. Correspondingly, liquid cannot be dispensed from the vapor-recovery-activated auto-shutoff nozzle 1.

It is contemplated that the linkage means 50' or the valve means 30 could additionally control, either directly or indirectly, the movement of an indicator (not shown) mounted on the auto-shutoff nozzle 1. The indicator would visually indicate whether the valve means 30 is in its valve-open or valve-closed configuration.

The deactivation means 40 is for re-configuring the linkage means 50' from the enabled configuration to the disabled configuration, in response to a condition of the fluid in the vapor recovery conduit 19, thereby precluding the openable and closable valve means 30 from being controlled by the manually operable trigger means to its open configuration, until the linkage means 50' is reset to its enabled configuration.

In the first preferred embodiment, as illustrated, the deactivation means 40 comprises a pressure sensing means 43 responsive to the condition of fluid pressure in the vapor recovery conduit 19. The deactivation means 40 also comprises a fluid communication conduit 14 connecting the pressure sensing means 43 and the vapor recovery conduit 19 in fluid communication one with the other. The top end 14*a* of the fluid communication conduit 14 is connected to a third opening 15*c* of the "T"-connector 15 and the bottom end 14*b* of the fluid communication conduit 14 is connected to the pressure sensing means 43 at a barbed fitting 49, as can be seen in FIG. 8. Accordingly, the pressure sensing means 43 is in fluid communication with the vapor recovery conduit 19 and the vapor delivery hose 12. In this manner, any change in fluid pressure within the vapor recovery conduit 19, the "T"-connector 15, the fluid communication conduit 14, and the vapor delivery hose 12 is realized at the pressure sensing means 43.

The pressure sensing means 43 comprises a movable pressure-actuated member 43*a* that is movable between an enabling position corresponding to the enabled configuration of the deactivation means 40, as is shown in FIG. 3, and a disabling position corresponding to the disabled configuration of the deactivation means 40, as is shown in FIG. 4. The movable pressure-actuated member is responsive to a decrease in fluid pressure in order to move from the enabling position to the disabling position.

More specifically, the movable pressure-actuated member 43*a* comprises a piston 43*a* having an "O"-ring 45, as can be best seen in FIG. 8, movable within a co-operating cylinder 42 between the enabling position and the disabling position. The piston 43*a* is retained within the cylinder 42 by means of a screw cap 47 threadably engaged onto a threaded opening 62. The movable pressure-actuated member 43*a* of the pressure sensing means 43 is physically connected via a shaft member 44 to the linkage means 50', at the linkage elbow 55*a*, with a piston shaft clasp 48 engaging the linkage pivot 55.

Also, the present invention further comprises, as can be best seen in FIG. 8, further comprises means for biasing the movable pressure-actuated member 43*a* to the enabling position. The means for biasing the movable pressure-actuated member 43*a* comprises a coil spring 46 that is disposed within the co-operating cylinder 42 so as to be in compression.

Alternatively, it is contemplated that the pressure sensing means 43 could comprise a movable pressure-actuated member in the form of a diaphragm, a resiliently deformable bellows, or similar. Also alternatively, it is contemplated that the deactivation means 40 could comprise an electronic pressure sensing means in fluid communication with the vapor recovery conduit and connected in signal communicating relation with an electrically powered solenoid, or the like, that moves the linkage means between the enabled configuration and the disabled configuration. Also alternatively, the deactivation means could comprise an electronic pressure sensing means in fluid communication with the vapor recovery conduit and connected in signal communicating relation with an electrically powered solenoid. The electrically powered solenoid works to actuate the valve means directly from a valve-closed configuration to a valve open configuration when the trigger is operated from its rest position to its in-use position. The electrically powered solenoid returns the valve means back to a valve-closed configuration when the trigger means is operated from an in-use position to its rest position or in response to the pressure sensing means sensing a specific condition within the vapor recovery conduit.

Reference will now be made to FIGS. 3 through 6 to describe the vapor-recovery-activated auto-shutoff fluid exchange system 2, the vapor-recovery-activated auto-shutoff nozzle 1 and the vapor-recovery-activated auto-shutoff mechanism 40 according to the present invention, in use.

As can be seen in FIG. 3, the linkage means 50' is in its enabled configuration. Accordingly, the trigger handle 41 can control the valve 30. The normally closed axial flow type valve 30 is in its valve-closed configuration.

In FIG. 4, the trigger handle 41 has been moved upwardly to an in-use position, as indicated by arrow "A". The first linkage arm 50 and a second linkage arm 51 have correspondingly conveyed the movement of the trigger handle 41 to the movable valve mechanism 30*m* via the pusher linkage arm 52 so as to open the valve 30 thus permitting liquid to be able to pass through the liquid delivery conduit 11 from the source container 3 to the destination container 4. Concurrently, vapor can pass through the vapor recovery conduit 12 from the destination container 4 to the source container 3.

In FIG. 5, the deactivation means 40 has been reconfigured to its disabled configuration, which occurs when the vapor-receiving inlet 19*a* of the vapor recovery conduit 19 becomes obstructed. Such obstruction typically occurs when the vapor-receiving inlet 19*a* of the vapor recovery conduit 19 becomes covered by the rising liquid (not specifically shown) in the destination container 4 (not specifically shown) as it becomes full. When this occurs, the fluid pressure within the vapor recovery conduit 12, the vapor conduit 19, the fluid communication conduit 14 and the "T"-connector 15 decreases correspondingly as the liquid and vapor pumping means 5 continues to pump vapor. This decrease in vapor pressure within the vapor recovery conduit 12 is then responded to by the pressure sensing means 43 where the piston 43*a* will accordingly be suctioned downwardly, thus moving the linkage means 50' from its enabled configuration to its disabled configuration, as indicated by arrow "B". The openable and closable valve means 30 is thereby precluded from being controlled by the manually operable trigger means 41 to its open configuration, until the linkage means 50' is reset to its enabled configuration. FIG. 6 shows the trigger handle 41 moving downwardly towards its rest position, as indicated by arrow "C". When the trigger handle 41 has returned to its rest position and the linkage means 50' has been reset to its enabled configuration, as is shown in FIG. 3, by the coil spring 46 acting on the piston 43*a*, the trigger handle 41 is again able to control the valve, via operation of the trigger handle 41 by a user.

Reference will now be made to FIG. 7 which shows an alternative embodiment of the auto-shutoff mechanism, nozzle and system of the present invention, which is very similar to the first preferred embodiment auto-shutoff mechanism, nozzle and system of the present invention. Accordingly, the parts of the alternative embodiment of the auto-shutoff mechanism, nozzle and system that are the same as in the first preferred embodiment auto-shutoff mechanism, nozzle and system are indicated by like reference numerals. FIGS. 1 through 6 of the first preferred embodiment represent a very basic inexpensive design for the vapor recovery auto-shutoff nozzle 1 where the liquid delivery conduit 26 and the vapor recovery conduit 19 are merely housed within the nozzle 1. FIG. 7 illustrates an alternative embodiment of the auto-shutoff mechanism, nozzle and system of the present invention wherein a spout 121 includes a portion of the liquid delivery conduit 126 and a portion of the vapor recovery conduit 119. Further, the spout 121 is secured in removable and replaceable relation on the nozzle 1 by means of a screw cap 110. The screw cap 110 threadably engages the cooperating threads 122 on the annular wall 124 of a coupling means 117 to thereby secure the spout 121 in place via an air-tight leak-proof connection. The hollow interior 118 of the coupling means 117 is in fluid communication with the vapor recovery conduit 119 to receive vapor from the inlet 119*a* of the vapor recovery conduit 119. The inlet end 112*a* of the elongate flexible vapor delivery hose 112 is also connected in fluid communication with the hollow interior 118 of the coupling means 117, to thereby receive vapor therefrom. The fluid communication conduit 14 is also connected in fluid communication with the hollow interior 118 of the coupling means 117.

Reference will now be made to FIG. 9, which shows a second preferred embodiment of the auto-shutoff mechanism 240, nozzle 201 and system 202 of the present invention. The second preferred embodiment auto-shutoff mechanism 240, nozzle 201 and system 202 of the present invention is similar to the first preferred embodiment auto-shutoff mechanism 40, nozzle 1 and system 2 except that the liquid and vapor pump 205 is manually operable typically by means of a user's hand. Further, the source container 203 is a fifty-five gallon drum. The liquid and vapor pump 205 is shown detached from the source container 203 for the sake of clarity.

Reference will now be made to FIG. 10, which shows a third preferred embodiment of the auto-shutoff mechanism 340, nozzle 301 and system 302 of the present invention. The third preferred embodiment auto-shutoff mechanism 340, nozzle 301 and system 302 of the present invention is similar to the first preferred embodiment auto-shutoff mechanism 40, nozzle 1 and system 2 except that the liquid and vapor pump 305 is driven by an selectively controllable actuation mechanism, specifically an electrically powered motor 306, that is operable typically by means of a switch (not specifically shown) that is activated by use or operation of the nozzle 201. Further, the source container 303 is a larger portable fuel container and the destination container 304 is an upright fuel tank.

Alternatively, it is contemplated that the deactivation means 40 could comprise an electronic pressure sensing means in fluid communication with the vapor recovery conduit and connected in signal communicating relation with an electrically powered solenoid, or the like, that moves the linkage means between the enabled configuration and the disabled configuration, where the deactivation means could be located either within the nozzle, the vicinity of the electric motor, or elsewhere. Also alternatively, the deactivation means could comprise an electronic pressure sensing means in fluid communication with the vapor recovery conduit and connected in signal communicating relation with an electrically powered solenoid that works to actuate the valve means directly from a valve-closed configuration to a valve open configuration and back to a valve-closed configuration. The deactivation means could be located either within the nozzle, the vicinity of the electric motor, or elsewhere.

Reference will now be made to FIG. 11, which shows a fourth preferred embodiment of the auto-shutoff mechanism 440, nozzle 401 and system 402 of the present invention. The fourth preferred embodiment auto-shutoff mechanism 440, nozzle 401 and system 402 of the present invention is similar to the third preferred embodiment auto-shutoff mechanism 340, nozzle 301 and system 302 except that the fourth preferred embodiment auto-shutoff mechanism 440, nozzle 401 and system 402 of the present invention are installed in a gasoline station. Accordingly, the source container 403 is a large underground tank.

Alternatively, the illustrated vapor recovery conduit 19 could be an unobstructed channel for air and vapor to pass through. Also alternatively, the vapor recovery conduit 19 could have a valve that would prevent or restrict the flow of liquid passing through it. Such a valve could be activated by the flow of fluid within the vapor recovery conduit 19 and could be something such as a ball bearing, which would very easily get caught up in the flow of liquid but not in the flow of air and vapor. The flow of liquid within the vapor recovery conduit 19 could very readily carry the ball bearing to a bottle neck created in the vapor recovery conduit 19 where it would block or greatly restrict the flow of liquid passing through. This blockage would then cause the pressure within the vapor recovery conduit 19 to decrease, as the vapor pump continued to pump vapor, until a point where the nozzle's deactivation means 40 would click off the valve 30. Likewise, the "T"-connection 15 could have a similar vapor valve system that would prevent the flow of liquid through vapor recovery conduit 19. Further, the fluid valve 30 shown is an axial flow valve, but any alternate means in which to control the fluid flow could be employed.

In yet a further alternative embodiment, it is contemplated that the vapour recovery conduit 19 has an openable and closable valve mounted therein for precluding and permitting the flow of vapor therethrough. The valve is also operatively connected to the liquid delivery conduit valve 30, such that the valve in the vapour recovery conduit 19 would open and close generally simultaneously with the valve 30.

In another alternative embodiment, it is contemplated that the valve means and the deactivation means could be located exteriorly to the nozzle. For instance, they could be located in the vicinity of the liquid and vapor pumping means, more specifically mounted on the liquid and vapor pumping means. The deactivation means could comprise an electronic pressure sensing means in fluid communication with the vapor recovery conduit and connected in signal communicating relation with an electrically powered solenoid, or the like. The electronic pressure sensing means would move the linkage means between the enabled configuration and the disabled configuration, thereby controlling the valve means.

As can be understood from the above description and from the accompanying drawings, the present invention provides an auto-shutoff nozzle, which utilizes the airflow of the vapor recovery means or fluid flow through the vapor recovery conduit of the nozzle to cause the nozzle to automatically shutoff as the receiving container is nearly full, which nozzle is usable in a portable fuel transfer system, and which utilizes the airflow of the vapor recovery means or fluid flow through the vapor recovery conduit of the nozzle to cause the nozzle to automatically shut off as the receiving container is nearly full, which nozzle is usable in a gasoline filling station, and which utilizes the airflow of the vapor recovery means or fluid flow through the vapor recovery conduit of the nozzle to cause the nozzle to automatically shut off as the receiving container is nearly full, and wherein the spout 21 is an auto-closure spout, which utilizes the airflow of the vapor recovery means or fluid flow through the vapor recovery conduit of the nozzle to cause the nozzle to automatically shut off as the receiving container is nearly full, and wherein the nozzle is usable in a liquid delivery system having vapor recovery, all of which features are unknown in the prior art.

Other variations of the above principles will be apparent to those who are knowledgeable in the field of the invention, and such variations are considered to be within the scope of the present invention. Further, other modifications and alterations may be used in the design and manufacture of the auto-shutoff mechanism, nozzle and system of the present invention without departing from the spirit and scope of the accompanying claims.

I claim:

1. A vapor-recovery-activated auto-shutoff dispenser for delivering liquid from a liquid source external to the dispenser to a liquid destination external to the dispenser, said vapor-recovery-activated auto-shutoff dispenser comprising:

a liquid delivery conduit having a liquid-receiving inlet and a liquid-dispensing outlet;

a vapor recovery conduit for recovering vapor from the liquid destination to the liquid source, the vapor recovery conduit having a vapor-receiving inlet and a vapor-conveying outlet;

an openable and closable valve selectively movable between a valve-closed configuration whereat liquid is precluded from being dispensed from said liquid-dispensing outlet of said liquid delivery conduit and a valve-open configuration whereat liquid is permitted to be dispensed from said liquid-dispensing outlet of said liquid delivery conduit;

a biasing member for biasing said valve to said valve-closed configuration;

an actuator movable between a rest position and at least one in-use position, for permitting selective operation of said valve between said valve-closed configuration and said valve-open configuration;

at least one linkage member operatively connecting said actuator and said valve;

wherein said at least one linkage is re-configurable between:

an enabled configuration whereat said valve is controllable via said actuator, such that said rest position of said actuator corresponds to said valve-closed configuration of said valve and said in-use position of said actuator corresponds to said valve-open configuration of said valve, and a disabled configuration whereat said actuator is precluded from controlling said valve, and said valve is therefore biased to said valve-closed configuration; and, a deactivation mechanism for re-configuring said at least one linkage member from said enabled configuration to said disabled configuration, in response to a condition of the fluid in said vapor recovery conduit, thereby precluding said openable and closable valve from being controlled by said actuator to its valve-open configuration, until said at least one linkage member is reset to its enabled configuration.

2. The vapor-recovery-activated auto-shutoff dispenser of claim 1, wherein said deactivation mechanism comprises a pressure sensor responsive to the condition of fluid pressure in said vapor recovery conduit.

3. The vapor-recovery-activated auto-shutoff dispenser of claim 2, wherein said pressure sensor is in fluid communication with said vapor recovery conduit.

4. The vapor-recovery-activated auto-shutoff dispenser of claim 3, wherein said deactivation mechanism comprises a fluid communication conduit connecting said pressure sensor and said vapor recovery conduit in fluid communication one with the other.

5. The vapor-recovery-activated auto-shutoff dispenser of claim 2, wherein said pressure sensor comprises a movable pressure-actuated member that is movable between an enabling position corresponding to the enabled configuration of said deactivation mechanism and a disabling position corresponding to the disabled configuration of said deactivation mechanism.

6. The vapor-recovery-activated auto-shutoff dispenser of claim 5, wherein said movable pressure-actuated member of said pressure sensor is responsive to a decrease in pressure in order to move from said enabling position to said disabling position.

7. The vapor-recovery-activated auto-shutoff dispenser of claim 5, further comprising means for biasing said movable pressure-actuated member to said enabling position.

8. The vapor-recovery-activated auto-shutoff dispenser of claim 5, wherein said movable pressure-actuated member comprises a piston movable within a co-operating cylinder between said enabling position and said disabling position.

9. The vapor-recovery-activated auto-shutoff dispenser of claim 5, wherein said at least one linkage member comprises a first linkage arm and a second linkage arm connected together one to the other in angularly variable relation at a linkage elbow.

10. The vapor-recovery-activated auto-shutoff dispenser of claim 9, wherein said first linkage arm and said second linkage arm are pivotally connected one to the other at said linkage elbow.

11. The vapor-recovery-activated auto-shutoff dispenser of claim 9, wherein said movable pressure-actuated member of said pressure sensor is connected via a shaft member to said at least one linkage member.

12. The vapor-recovery-activated auto-shutoff dispenser of claim 9, wherein said actuator comprises a handle.

13. The vapor-recovery-activated auto-shutoff dispenser of claim 12, wherein said first linkage arm of said at least one linkage member is connected in angularly variable relation to said handle.

14. The vapor-recovery-activated auto-shutoff dispenser of claim 9, wherein said second linkage arm of said at least one linkage member is connected to said valve.

15. A vapor-recovery-activated auto-shutoff mechanism for use in a dispenser, said dispenser for delivering liquid from a liquid source external to the dispenser to a liquid destination external to the dispenser and including a liquid delivery conduit and a vapor recovery conduit, the vapor recovery conduit being configured to recover vapor from the liquid destination to the liquid source, said vapor-recovery-activated auto-shutoff mechanism comprising:

at least one linkage member for operatively connecting an actuator and a valve, and re-configurable between:

an enabled configuration whereat said valve is controllable via said actuator, and a disabled configuration whereat said actuator is precluded from controlling said valve, and said valve is in a closed configuration; and, a deactivation mechanism for re-configuring said at least one linkage member from said enabled configuration to said disabled configuration, in response to a condition of the fluid in said vapor recovery conduit, thereby precluding said openable and closable valve from being controlled by said actuator to a valve-open configuration, until said at least one linkage member is reset to its enabled configuration.

16. The vapor-recovery-activated auto-shutoff mechanism of claim 15, wherein said deactivation mechanism comprises a pressure sensor responsive to the condition of fluid pressure in said vapor recovery conduit.

17. A vapor-recovery-activated auto-shutoff fluid exchange system for pumping liquid from a source container and concurrently pumping vapor from a destination container, said vapor-recovery-activated auto-shutoff fluid exchange system comprising:

the source container for retaining liquid and vapor therein;

a pump for pumping liquid from said source container and for pumping vapor into said source container, the pump having a liquid inlet, a liquid outlet, a vapor inlet and a vapor outlet;

wherein said liquid inlet and said vapor outlet of said pump are in fluid communication with said source container;

a dispenser having a liquid delivery conduit having a liquid-receiving inlet and a liquid-dispensing outlet and vapor recovery conduit having a vapor-receiving inlet and a vapor-conveying outlet, the vapor recovery conduit being configured to convey vapor from the destination container to the source container, the destination container and the source container being external to the dispenser;

a liquid delivery member for delivering liquid from said liquid outlet of said pump to said liquid-receiving inlet of said dispenser;

a vapor delivery member for delivering vapor from said vapor-conveying outlet of said dispenser to said vapor inlet of said pump;

a selectively controllable actuation mechanism for actuating said pump;

an openable and closable valve selectively movable between a valve-closed configuration whereat liquid is precluded from being dispensed from said liquid-dispensing outlet of said liquid delivery conduit and a valve-open configuration whereat liquid is permitted to be dispensed from said liquid-dispensing outlet of said liquid delivery conduit;

a biasing member for biasing said valve to said valve-closed configuration;

an actuator movable between a rest position and at least one in-use position, for permitting selective operation of said valve between said valve-closed configuration and said valve-open configuration;

at least one linkage member operatively connecting said actuator and said valve;

wherein said at least one linkage member is re-configurable between an enabled configuration whereat said valve is controllable via said actuator, such that said rest position of said actuator corresponds to said valve-closed configuration of said valve and said in-use position of said actuator corresponds to said valve-open configuration of said valve, and a disabled configuration whereat said actuator is precluded from controlling said valve, and said valve is therefore biased to said valve-closed configuration; and, a deactivation mechanism for re-configuring said at least one linkage member from said enabled configuration to said disabled configuration, in response to a condition of the fluid in said vapor recovery conduit, thereby precluding said openable and closable valve from being controlled by said actuator to its valve-open configuration, until said at least one linkage member is reset to its enabled configuration.

18. The vapor-recovery-activated auto-shutoff fluid exchange system of claim 17, wherein said deactivation mechanism comprises a pressure sensor responsive to the condition of fluid pressure in said vapor recovery conduit.

19. The vapor-recovery-activated auto-shutoff dispenser of claim 1, wherein the dispenser comprises a single vapor recovery conduit, and the deactivation mechanism is responsive to the condition of the fluid in the single vapor recovery conduit.

20. The vapor-recovery-activated auto-shutoff dispenser of claim 1, wherein the vapor recovery conduit branches into a first passage in fluid communication with the deactivation mechanism and a second passage in fluid communication with the vapor-conveying outlet.

* * * * *